United States Patent [19]

Iwai et al.

[11] 4,165,173

[45] Aug. 21, 1979

[54] TONER REMOVING MEANS FOR PHOTOSENSITIVE DRUMS FOR ELECTROPHOTOGRAPHY

[75] Inventors: Fumio Iwai, Inagi; Junichi Koiso; Masakazu Kokiso, both of Hachioji; Masaru Inoue, Hino, all of Japan

[73] Assignee: Konishiroku Photo Industry Co., Ltd., Tokyo, Japan

[21] Appl. No.: 837,160

[22] Filed: Sep. 28, 1977

[30] Foreign Application Priority Data

Oct. 4, 1976 [JP] Japan ..... 51-119054

[51] Int. Cl.[2] ..... G03G 21/00

[52] U.S. Cl. ..... 355/15; 15/256.52

[58] Field of Search ..... 15/256.51, 256.52; 118/652; 355/15

[56] References Cited

U.S. PATENT DOCUMENTS

| | | | |
|---|---|---|---|
| 3,634,077 | 1/1972 | Sullivan | 118/652 X |
| 3,776,631 | 12/1973 | Mammino | 355/15 |
| 3,838,472 | 10/1974 | Oriel | 355/15 X |
| 3,927,937 | 12/1975 | Keyzer | 15/256.52 X |
| 4,052,959 | 10/1977 | Hayashi et al. | 118/652 X |

OTHER PUBLICATIONS

Thoursen, "Vibrating Cleaning Blade for Photoreceptor," Xerox Disclosure Journal, vol. 1, No. 4, Apr. 1976, pp. 81.

*Primary Examiner*—A. D. Pellinen
*Attorney, Agent, or Firm*—James E. Nilles

[57] ABSTRACT

For removing toner from a photosensitive drum roll for electrophotography, a blade contacts the surface of the drum roll at a location where said surface is moving upwardly, to scrape residual toner therefrom. A resilient transfer roll, spaced below the blade, carries away toner that falls from the drum roll. The transfer roll is directly rotatably driven by the drum roll. One of the rolls has enlarged diameter end portions for driving contact between the rolls at zones outside the image area of the drum roll. The resilient transfer roll is urged toward the drum roll under a biasing force that radially compresses its end portions to maintain it either in merely line contact with the image area of the drum roll or spaced from that area by a distance less than the diameter of toner particles.

3 Claims, 5 Drawing Figures

TONER REMOVING MEANS FOR PHOTOSENSITIVE DRUMS FOR ELECTROPHOTOGRAPHY

The present invention relates to a toner removing means for photosensitive drums for electrophotography.

In electrophotography, the greater part of the toner of a developed image is transferred to a transfer sheet but a small amount of toner always remains on the surface of a photosensitive drum after the abovementioned transfer of toner has been finished. Such residual toner must be removed from the photosensitive drum before the operation of forming a new subsequent image.

The cleaning of a photosensitive drum for electrophotography has been heretofore carried out by various kinds of methods. One of such methods is disclosed in U.S. Pat. No. 3,742,551, U.S. Pat. No. 3,838,472, Japanese Laid-Open Publication No. 43,342/1973 and Japanese Laid-Open Publication No. 43343/1973. In this method, a blade is used to scrape the residual toner to cause it to fall downward from the photosensitive drum, and the toner, which is dropped along the surface of the photosensitive drum, is intercepted by a sealed roll driven by the photosensitive drum by which the toner is thereafter carried and discharged. Since the sealed roll is driven by the photosensitive drum in the above method, it must be surely pressed against the photosensitive drum.

Therefore, the above method has drawbacks in the following respects.

When, for example, the photosensitive drum is operated for a long time due to a large number of the photographs to be copied, the surface of photosensitive drum is damaged by the toner, or toner filming phenomenon occurs, to shorten the life of the photosensitive drum.

An object of the present invention is to lengthen the life of a photosensitive drum for electrophotography by disposing near a photosensitive drum a toner transfer roll for transferring the residual toner scraped off the photosensitive drum with a blade, in such a manner that the toner transfer roll is substantially in contact with the photosensitive roll in the sense that there is either a gap between them that is narrower than the diameter of particles of the toner, or that the toner transfer roll is in merely line contact with the photosensitive roll, so as to reduce to the minimum the pressing force of the toner transfer roll against the surface of the photosensitive drum, the toner filming phenomenon in the image region and damage to the photosensitive drum being thus prevented. Other objects of the present invention and the characteristics thereof will be apparent as the description with reference to the accompanying drawings progresses below.

Figure 1:
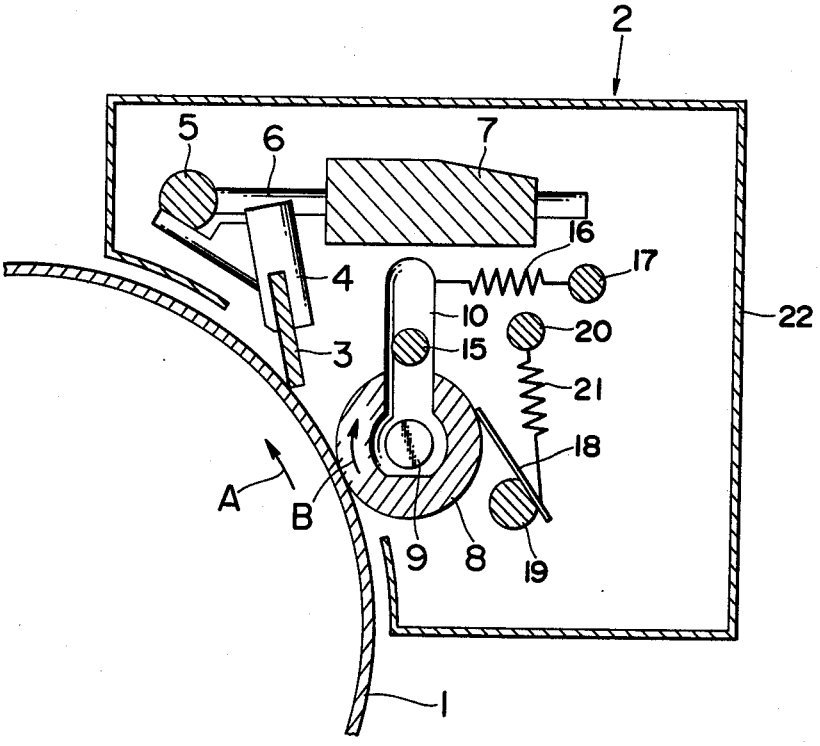

FIG. 1 is a cross-sectional view of a toner removing means of the present invention, and FIGS. 2*a* and 3*a* and FIGS. 2*b* and 3*b* are explanatory drawings showing the relation between toner transfer roll and photosensitive drum in the toner removing means of the present invention.

In the drawings, reference numeral 1 denotes a photosensitive drum rotating in the direction of an arrow A. After the electrifying, exposing, developing, transferring and cleaning operations have been performed, the residual toner on drum 1 is removed as the final operation with a toner cleaning means 2 which will be described in detail later.

Reference numeral 3 denotes an elastic blade supported by a rotatable shaft 5 via a metallic blade-retaining means 4 so that blade 3 contacts photosensitive drum 1. The angle made by blade 3 and the photosensitive drum 1 contacted thereby is determined so that an optimum cleaning effect can be obtained. Reference numeral 6 denotes an arm provided with a weight 7 thereon and secured to shaft 5. By adjusting weight 7, the blade 3 is pressed against photosensitive drum 1 in such a manner that the toner cleaning operation can be performed most effectively. The point on photosensitive drum 1 where photosensitive drum 1 and blade 3 contact each other is above the horizontal diameter line of photosensitive drum 1 so that the residual toner scraped by blade 3 is dropped downward along the surface of photosensitive drum 1.

Reference numeral 8 denotes a toner transfer roll made of an elastic material and disposed below blade 3 and in parallel to photosensitive roll 1 so that the dropping residual toner can be thereby intercepted. The toner transfer roll 8 is rotatable around a shaft 9 which is carried at one end of a metallic support 10.

Figure 2A:
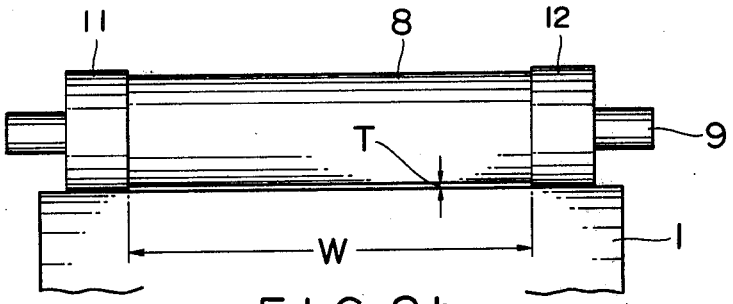
Figure 2B:
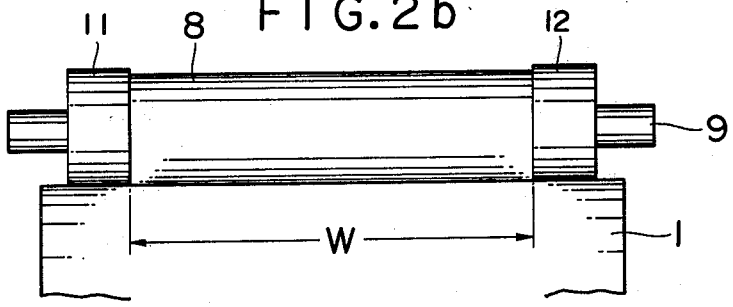
Figure 3A:
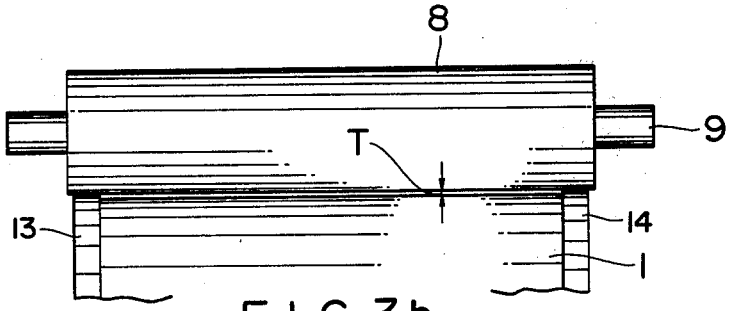
Figure 3B:
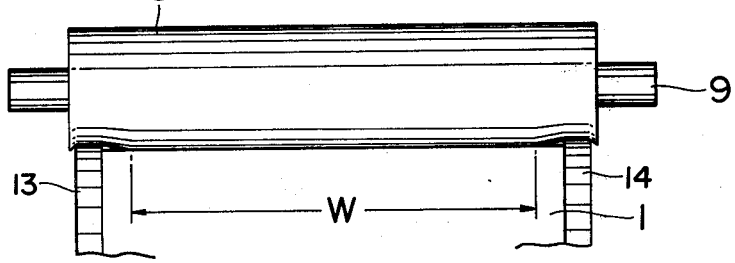

The transfer roll 8 is driven and rotated in the direction of an arrow B by photosensitive drum 1 while flanges 11, 12 of a diameter larger than that of transfer roll 8, formed at both end portions thereof, contact photosensitive drum 1, or while flanges 13, 14 formed at both end portions of photosensitive drum 1 contact transfer roll 8, as shown in FIGS. 2*a* and 3*a*. Whether flanges 11, 12 are formed on the end portions of the transfer roll 8 as shown in FIGS. 2*a* and 2*b* or flanges 13, 14 are formed on the end portions of the drum roll 1 as shown in FIGS. 3*a* and 3*b*, the flanges are outside that part W of the axial length of the drum roll 1 that comprises its image area.

Reference numeral 15 denotes a shaft on which metallic support 10 is rotatably mounted, and reference numeral 16 denotes a spring, one end of which is secured to the other end of metallic support 10, and the other end of which is secured to a stationary spring receiver 17. Since the photosensitive drum 1 and transfer roll 8 are in contact with each other via flanges 11, 12 or 13, 14 as shown in FIGS. 2*a* and 3*a*, a gap T tends to exist between the rolls 1 and 8 along the image forming zone W of the drum roll 1, and the residual toner being scraped would fall through gap T were it not for the radial compression of the end portions of the transfer roll 8 that is caused by the biasing force of spring 16. Therefore, in the present invention, the tension of spring 16 is adjusted to maintain substantial contact between transfer roll 8 and photosensitive drum 1 along the zone W in the sense of either maintaining a small gap therebetween, narrower than the diameter of particles of toner, or maintaining merely line contact between transfer roll 8 and photosensitive drum 1, as shown in FIGS. 2*b* and 3*b*.

Reference numeral 18 denotes a scraping blade for scraping the toner on transfer roll 8, which blade 18 is secured to a rotatable shaft 19 so as to be maintained in close contact with transfer roll 8 by a spring 21 secured to a stationary spring receiver 20.

Reference numeral 22 denotes a cleaning box, and the toner scraped and dropped by scraping blade 18 is accumulated in a storage region in the bottom portion of this box 22.

According to the present invention, the residual toner on photosensitive drum 1 is scraped and dropped by blade 3, falls along the surface of photosensitive drum 1, adheres to and is transferred by transfer roll 8 driven by photosensitive drum 1, and is scraped off transfer roll 8 by scraping blade 18 to be accumulated in the bottom portion of cleaning box 22.

Since the transfer roll 8 is so disposed that it is in merely line contact with photosensitive drum 1 or is spaced from it by a gap smaller than the diameter of particles of toner, the residual toner is never forcibly pressed against the surface of photosensitive drum 1 by the pressing force of transfer roll 8. Therefore, the residual toner can be completely removed by the blade 3 without any toner filming phenomenon. In addition, the surface of the photosensitive drum is never damaged by scratches on the surface of transfer roll 8 made by the pressing force of scraping blade 18. Even when a small amount of carrier is contained in the residual toner, no trouble occurs because transfer roll 8 never damages the surface of photosensitive drum 1. Thus, the life of photosensitive drum 1 is remarkably lengthened, or the drum 1 can sufficiently stand a long period of operation.

The present invention is not limited to the above described embodiment or, needless to say, the present invention includes all modifications and changes within the scope its claims.

What is claimed is:

1. In electrophotography apparatus comprising a drum roll that is rotated in one direction about a fixed axis and has a cylindrical, photosensitive image area surface portion that may carry residual toner when its rotation brings it to one location around the drum roll, residual toner removing means of the type comprising a blade that contacts said surface portion at said location and a resilient transfer roll rotatable on a coaxial shaft that extends parallel to the axis of the drum roll, said transfer roll being disposed adjacent to the drum roll at a location below said blade and having a cylindrical surface portion which opposes said image area surface portion, and said transfer roll serving for transfer away from the drum roll of residual toner that is scraped off of said image area surface portion by the blade and falls therefrom, said residual toner removing means being characterized by:

A. each of said rolls having a coaxial end portion at each of its ends, axially outward of its said surface portion,
   (1) said end portions on one roll being larger in diameter than the said cylindrical surface portion thereof, and
   (2) said end portions on the other roll being at least as large in diameter as the said cylindrical surface portion thereof; and B. means biasing said shaft laterally towards the axis of the drum roll with a force
   (1) which maintains said end portions on each roll in frictional driving engagement with those on the other roll so that rotation is imparted to the transfer roll directly by the drum roll, and
   (2) which radially compresses the end portions of the resilient transfer roll to maintain its shaft no closer to the drum roll axis than to permit merely line contact between said cylindrical surface portions, but no farther therefrom than to permit a space between those surface portions which is narrower than the diameter of toner particles.

2. The electrophotography apparatus of claim 1 wherein the direction of drum rotation and the location of said blade are such that said image area surface portion is moving generally upwardly as it passes the transfer roll and said blade.

3. The electrophotography apparatus of claim 2, wherein said residual toner removing means is further characterized by:

a second blade engaging said cylindrical surface portion of the transfer roll, substantially diametrically opposite the portion of the transfer roll that is adjacent to the drum roll.

* * * * *